United States Patent [19]

Edmonds et al.

[11] Patent Number: 4,848,859

[45] Date of Patent: Jul. 18, 1989

[54] KNOCKDOWN CABINET

[75] Inventors: Michael G. Edmonds, Bexley; Peter A. Dennis, Orpington, both of England

[73] Assignee: Kentinental Engineering Limited, Kent, England

[21] Appl. No.: 282,884

[22] Filed: Dec. 9, 1988

Related U.S. Application Data

[63] Continuation of Ser. No. 44,635, May 1, 1987, abandoned.

[30] Foreign Application Priority Data

May 2, 1986 [GB] United Kingdom ..... 8610839

[51] Int. Cl.[4] ..... A17B 43/00

[52] U.S. Cl. ..... 312/257.1; 312/250

[58] Field of Search ..... 312/257 R, 257 SM, 257 A, 312/250, 263

[56] References Cited

U.S. PATENT DOCUMENTS

| | | | |
|---|---|---|---|
| 1,735,375 | 11/1929 | Card et al. | 312/257 R |
| 3,305,076 | 2/1967 | Fleenor | 312/257 R |
| 3,955,863 | 5/1976 | Yellin | 312/257 R |
| 4,201,428 | 12/1978 | Johnson | 312/257 R |
| 4,288,132 | 9/1981 | Znamirowski et al. | 312/257 R |
| 4,426,935 | 1/1984 | Nikoden | 312/257 SM X |
| 4,462,647 | 7/1984 | Key | 312/257 R X |
| 4,616,890 | 10/1964 | Romick | 312/257 |

FOREIGN PATENT DOCUMENTS

| | | | |
|---|---|---|---|
| 2007989 | 9/1971 | Fed. Rep. of Germany | 312/257 R |
| 645808 | 9/1949 | United Kingdom . | |
| 2113989 | 2/1985 | United Kingdom . | |

*Primary Examiner*—Joseph Falk

*Attorney, Agent, or Firm*—Panitch Schwarze Jacobs and Nadel

[57] ABSTRACT

The invention concerns a knockdown cabinet, made from sheet metal material, having sufficient rigidity and strength to be used for storing goods and mounted on a base. The knockdown cabinet has a base and a top defining channels which in the assembled condition locate as a close fit around the top and bottom edges of the back and sides to retain the parts together without the use of screws or other fasteners. The base is mounted on wheels. An inverted U-shaped front frame member supports hinges for doors.

20 Claims, 5 Drawing Sheets

KNOCKDOWN CABINET

This application is a continuation of Ser. No. 044,635, filed May 1, 1987, now abandoned.

BACKGROUND OF THE INVENTION

This invention relates to a knockdown cabinet, that is a cabinet which can be assembled and dis-assembled and which is normally sold in the unassembled condition for easy storage and transport.

Many conventional knockdown cabinets have parts which are formed with holes and the parts are fastened together by screws or bolts or other separate fastening means inserted through these holes. The buyer, who is often inexperienced at assembling such cabinets, has difficulty exactly aligning the holes and the process can be time-consuming.

Knockdown cabinets are known, for example in U.S. Pat. Nos. 4,201,428 and 1735375 and U.K. Specification 645808, in which the various parts such as back, sides and top have formations along their edges which can be inter-engaged without using separate fastening members, by relative sliding movement between the parts parallel to those edges. In such known cabinets, the edge formations are complicated to produce and assembly is still difficult and time-consuming. None of these cabinets has a base on which the remainder of the cabinet is supported, instead they are constructed by joining a back, sides and top and then a floor is inserted supported on the sides. The constructions when assembled thus have the sides and back resting on the ground and are not suitable for support on wheels.

An object of the present invention is to construct a cabinet from sheet materials such as metal or alloy so that the sides, back, top, and front where present, are supported on the base which may rest directly on the ground or preferably is mounted on wheels. (The term wheels includes castors or other rolling or sliding members).

To assemble such a cabinet from its parts, the base is first placed on the ground, and then the remainder built up on the base. A further known construction is shown in British patent Specification 2113989 which showns a display stand made from plastics material and having a hinged wall located in an upwardly opening channel on a base which rests on the ground. A top also has a channel which fits over the wall. However, this stand is not constructed from sheet material but is moulded and does not have the necessary strength or rigidity required for use as a cabinet which may need to store a heavy object. The top and bottom edges of the hinged wall are a loose fit in the channels in the base and top and thus the stand has little rigidity.

SUMMARY OF THE INVENTION

The present invention provides a knockdown cabinet made from sheet material comprising a top, a base, a back and two sides, the bottom and top having respectively upwardly and downwardly turned sides edges forming the outer walls of horizontal channels extending along those edges and including locating means forming fixed parts of the top and base and providing inside walls of the horizontal channels, and the sides having inwardly turned bottom and top edges shaped to engage in the horizontal channels as a close location fit, so that the assembled cabinet is mounted on the base.

Such a cabinet is easy to assemble, the parts have uncomplicated edge formations formed by bending a sheet material, is built up and supported form the base, which can be mounted on wheels, and has sufficient strength and rigidity.

Preferably each of the sides has a front edge bent to define a vertical channel, and the cabinet includes a frame member having legs adapted to be located in respective ones of the vertical channel and a bridging member connecting the tops of the legs to form a top front frame member of the cabinet. The frame member increases the strength and rigidity of the cabinet and with advantage a door or doors are hinged directly to this frame member which has greater strength than the sides.

Preferably the legs of the frame member are a loose fit in the majority of the length of the vertical channels for easy assembly but each has a lower portion which is a close location fit in a lower portion of the associated vertical channel, preferably this lower portion extending into the associated horizontal channel in the base so that forces are transmitted directly to the base without introducing bending forces to the sides.

The horizontal channels in the top preferably have openings which are outwardly tapered. This helps the assembly of the top to the back and sides.

Preferably the top and base have back edges having respectively downwardly and upwardly turned lips there along and the back has planar upper and lower edges which fit between the lips of the top and base and the sides when the cabinet is assembled. With advantage the back has forwardly projecting side edges which locate outside the sides.

With this arrangement the parts are again easy to construct, locate against one another to form a stable rigid cabinet and produce a pleasant appearance with the outside of the sides being planar and surrounded by the edges of the top, base and back.

BRIEF DESCRIPTION OF THE DRAWINGS

One embodiment of cabinet in accordance with the invention, will now be described by way of example only with reference to the accompanying drawings of which.

DETAILED DESCRIPTION OF ONE EMBODIMENT

Figure 1:
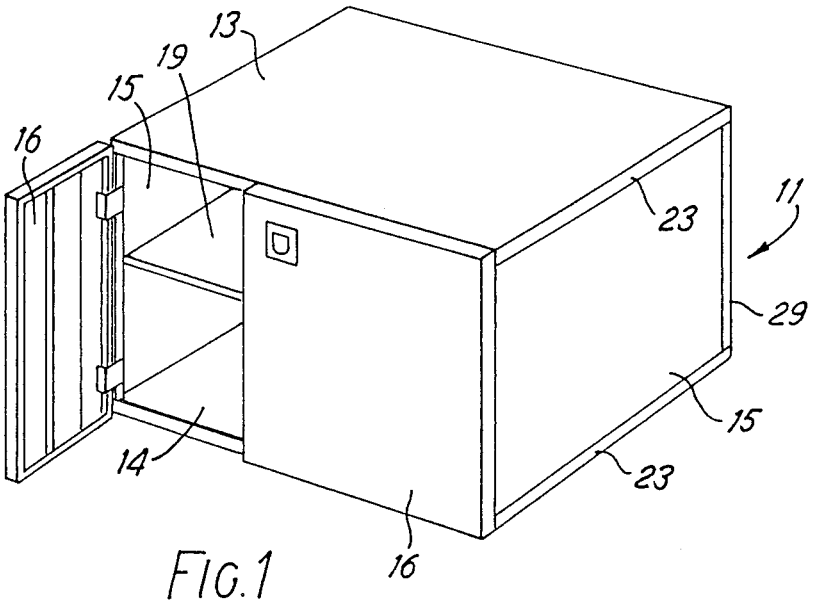
FIG. 1 is a perspective view of an assembled cabinet.
Figure 5:
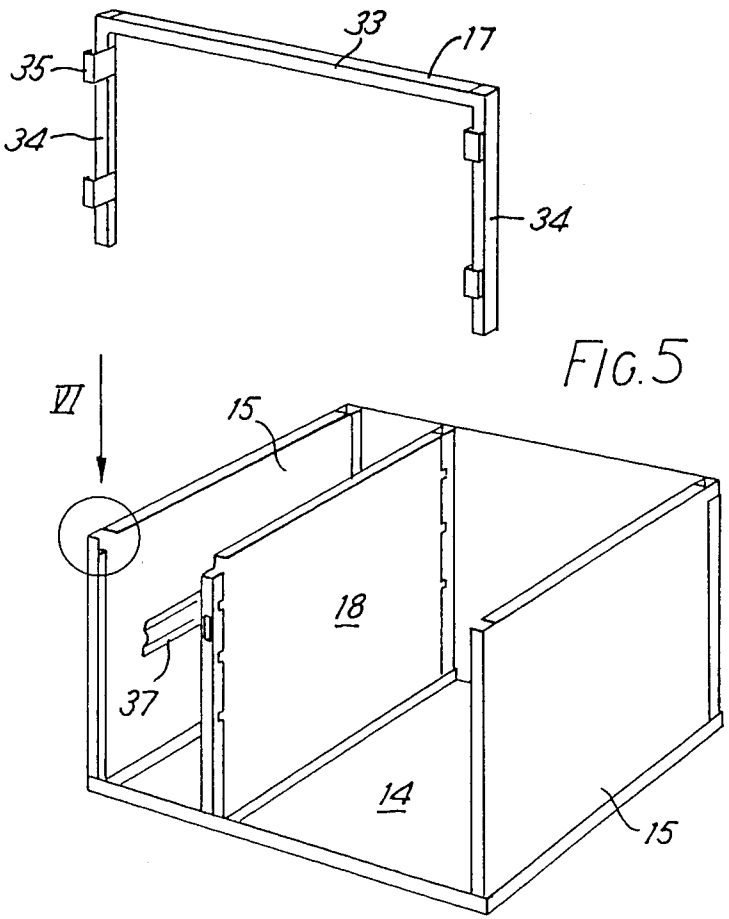
FIG. 5 is a view of the base, back and sides assembled and juxtaposed with a front frame.

The cabinet 11 is shown assembled in FIG. 1 and comprises a back 12, a top 13, a base 14, sides 15, front doors 16, a front frame 17 FIG. 5 a divider panel 18, shelves 19, 20 and angled sectioned cassette supports 21

Figure 2:
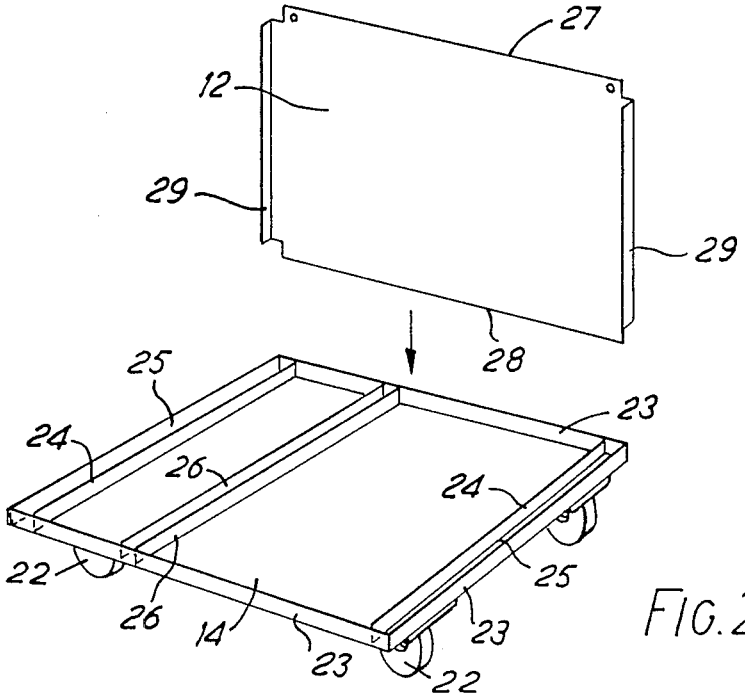
FIG. 2 is a view of the base and back juxtaposed.
Figure 3:
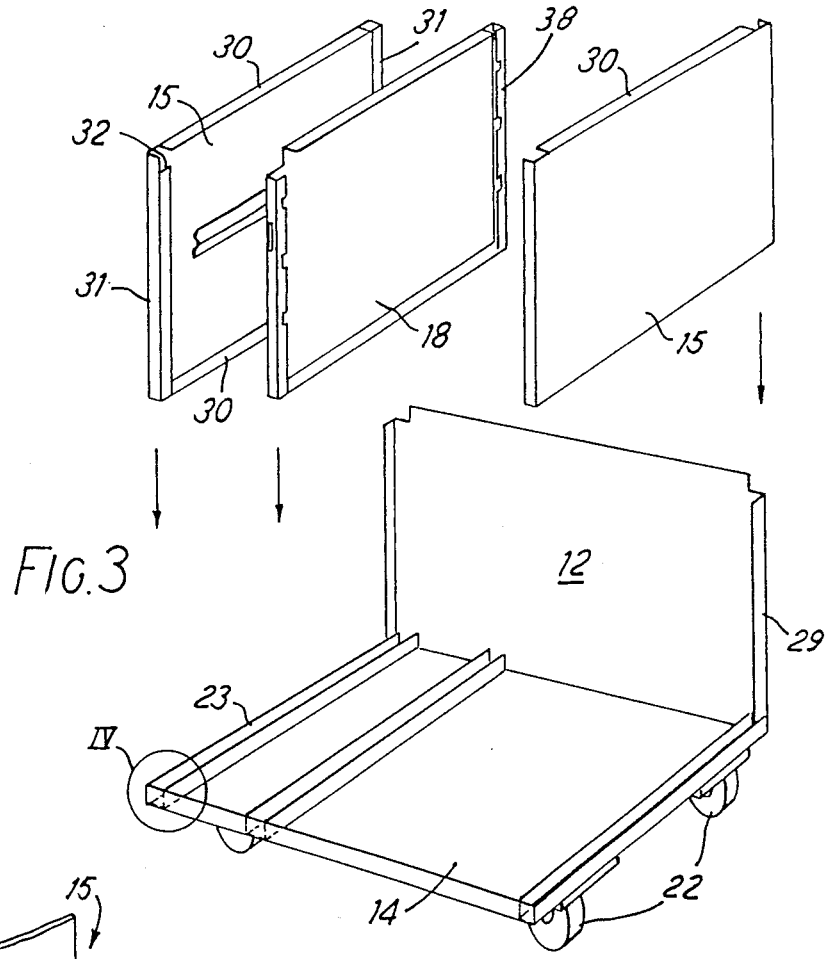
FIG. 3 is a view of the base and back assembled and juxtaposed with the sides and divider panel.
Figure 4:
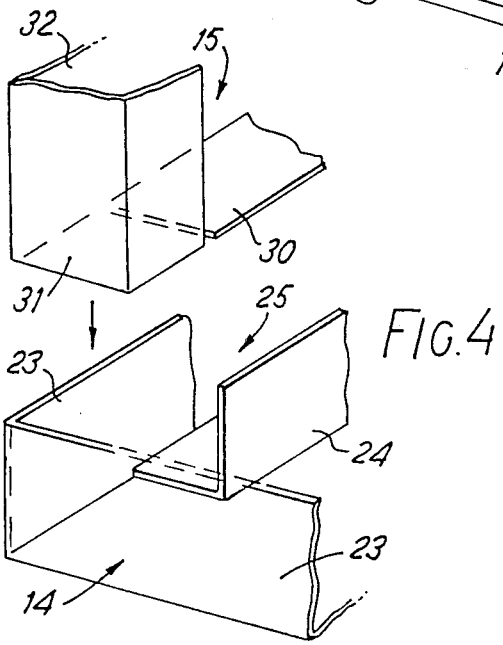
FIG. 4 is an enlarged view of the bottom left hand corner of the base and side.
Figure 6:
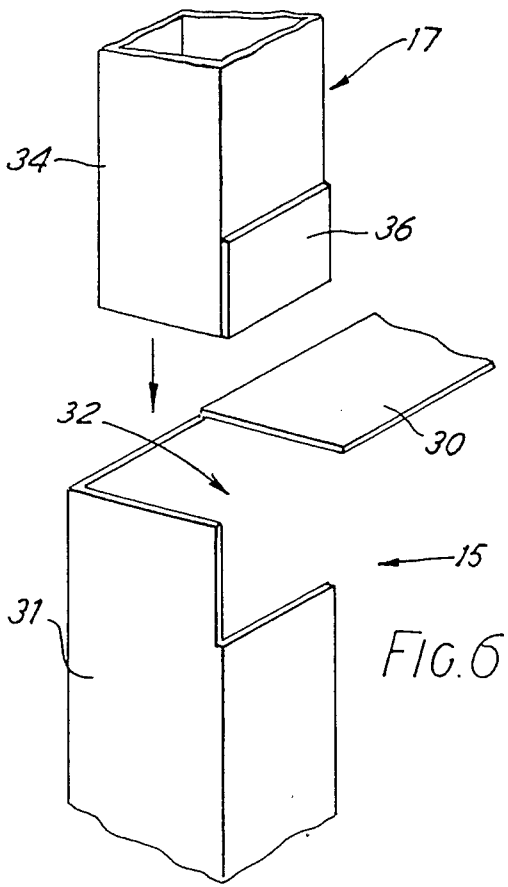
FIG. 6 is a view enlarged of the top left hand corner of the cabinet and bottom left hand part of the frame.
Figure 7:
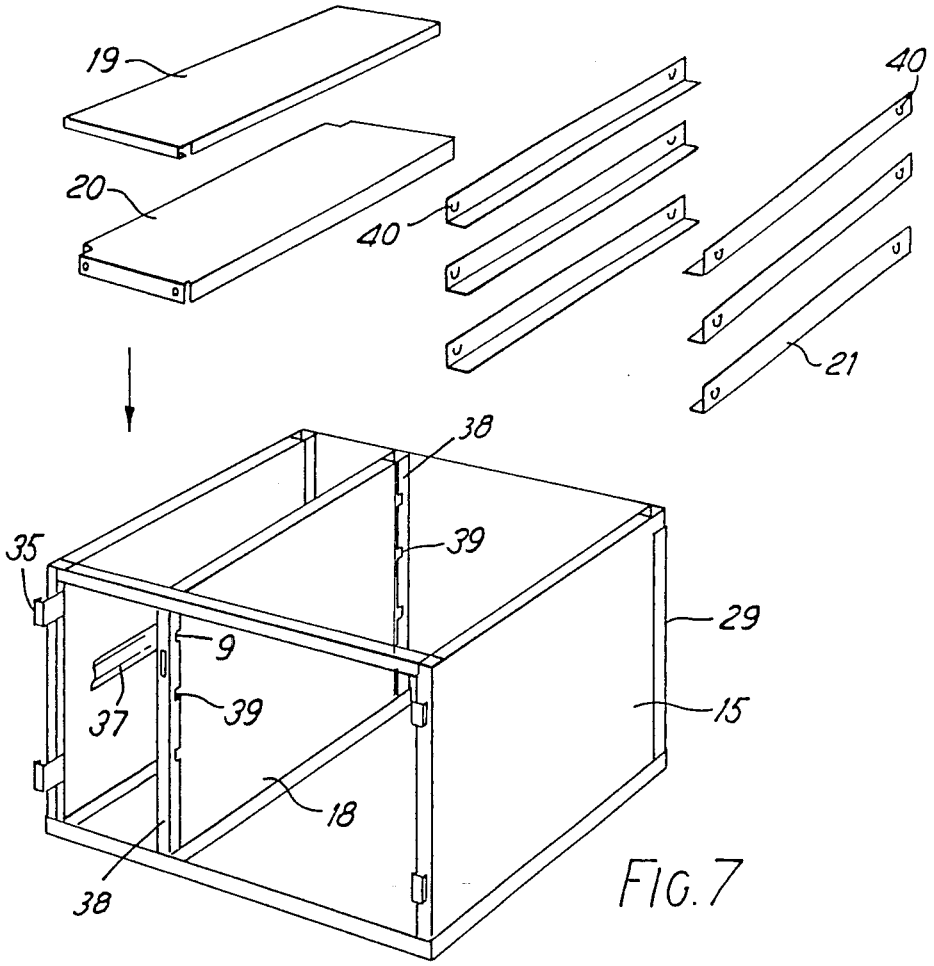
FIG. 7 is a view of the partially assembled cabinet with various shelf and shelf supports.
Figure 8:
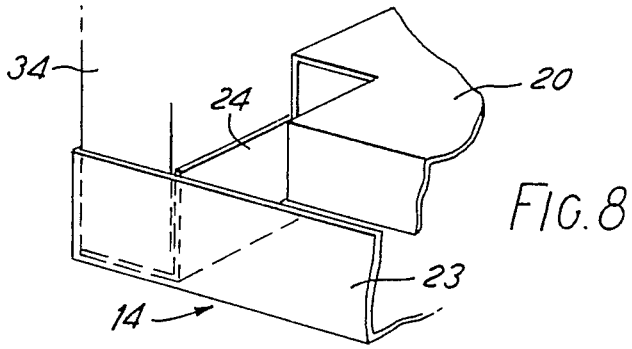
FIG. 8 is an enlarged view of the bottom left hand corner of FIG. 7 with a lower shelf in position.

FIG. 7. These parts are all made from sheet metal (which term includes alloys) and the base has pre-fixed thereto four wheels 22. All the parts can be stacked one on top of the other to form a compact package when not assembled, for example they can be packed into a box only 7" (18 cms) high. As seen in FIG. 2, the base 14 is of rectangular tray shape having an upstanding lip 23 all round its edge. The optional wheels 22 are pre-fixed to the underneath. Inner locating strips 24 extend within the base parallel to and adjacent the side lip portions to define upwardly opening, horizontal channels 25 to receive the bottom edges of the sides 15 as a close location fit. The bottoms of the sides are thus located in the channels against movement both inward and outward and forward and backward. Futher strips 26 define a parallel channel for locating the base of the divider panel 18 as a close location fit. The top 13 is formed with a similar lip 23 and similar locating strips 24 and 26 defining downwardly opening horizontal channels for receiving as a close location fit the top edges of the sides and divider panel. The back 12 is a piece of sheet metal having cut-a-way corners and forwardly projecting lips 29 along its sides. The top and bottom edges 27, 28 are dimensioned to fit between the lips 23 at the back of the base and top and the top and bottom edges of the sides 15, with lips 29 extending outside and engaging the back edges of the sides.

Each of the sides 15 has a top and bottom inwardly turned lip 30 designed to fit closely in the channels 25 and a double return lip 31 at its front and rear edges, the double return lip 31 at the front edge defining a vertical channel 32. The front frame member 17 (FIG. 5) is of square inverted U section having a front top crossbar 33 and depending legs 34 which are designed to be an easy fit in the channels 32. The legs 34 carry door hinge support means 35 permanently secured thereto. The bottom inner sides of the legs 34 are provided with pads 36 which are a close fit in the lower portions of the channels 32 (that is the portions located in the base channels 25) to provide a firm location for the frame relative to the base and sides. The front top corners of the sides and divider panel are cut away to accommodate the crossbar 33 located in these cutouts.

FIG. 7 shows various alternative forms of shelves or like supports. A lower shelf 20 is adapted to fit at the base of the left hand side of the cabinet while the downwardly turned lips at the sides of the upper shelf 19 will inter-engage shaped side pieces 37 attached to the inside of the side wall and divider at the left of the cabinet. The divider 18 has double return, front and back lips 38 formed with cutouts 39 which are also formed on the front and back lips of the right hand side 15. A series of angle sectioned, shelf supports 21 have tabs 40 which can locate in the cutouts 39 so that the supports 21 can support sliding shelves, drawers or cassettes.

Figure 9:
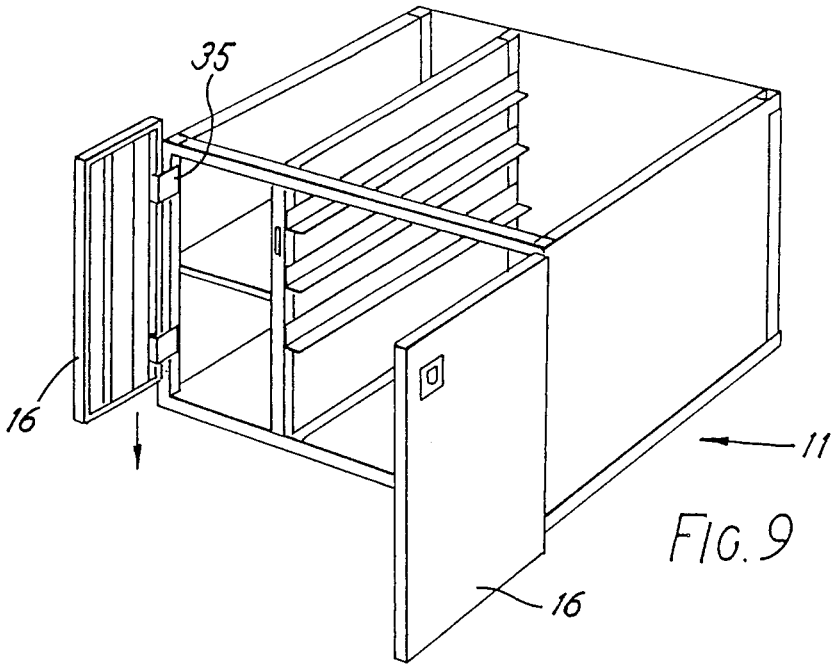
FIG. 9 is a view of the cabinet with the doors.
Figure 10:
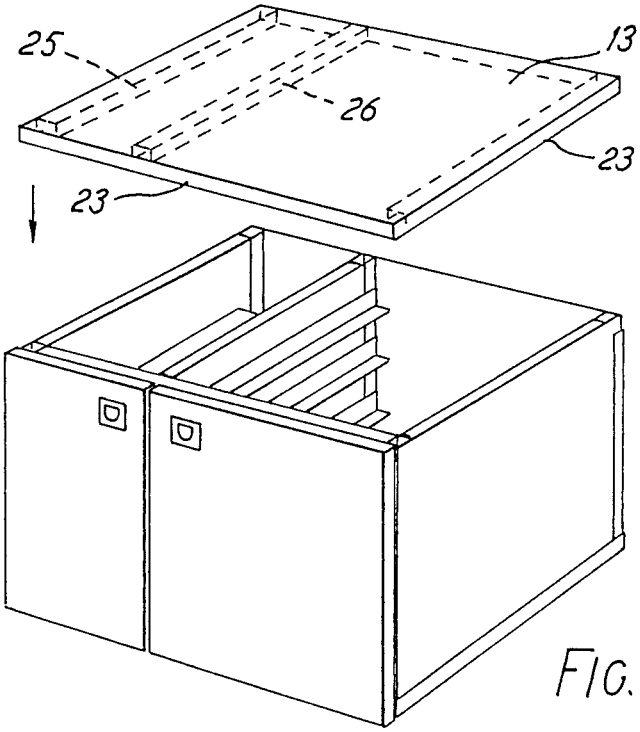
FIG. 10 is a view of the largely assembled cabinet with the top juxtaposed.

The doors 16 can be attached to the hinge support brackets 35 in known manner as shown in FIG. 9. The top 13 is designed to fit with the top edges of the sides extending as a close location fit into the channels 25, the divider panel fitting into the parallel channel and the outer lip 23 extending right round the top of the back, sides and frame 17. The openings to the channels 25 in the top may be outwardly tapered to make fitting of the top to the otherwise assembled cabinet easier.

The method of assembly is shown in the figures with the back being first fitted to the base, then the sides and divider panels, then the front frame, followed by any shelf or shelf support pieces, the doors and the top. It will be appreciated that all the pieces are merely pushed together and no external fastening means such as screws, bolts or clips are required. Because the top and base firmly locate the back and sides against both inward and outward movement and the front frame locates both with the sides, base and divider panel the cabinet so formed is sturdy enough to withstand considerable loads and resist bending or twisting forces.

We claim:

1. A knockdown cabinet made from sheet metal comprising a continuous closed, one-piece top, a one-piece base, a back and two sides; the top having downwardly turned side edges forming outer downwardly projecting side walls and including locating means integrally joined with the top and forming fixed inner downwardly projecting side walls of the top, the inner and outer downwardly projecting side walls defining downwardly opening, horizontal channels extending along the sides of the top, and the top further integrally including downwardly projecting front and back wall means for blocking opposing ends of the channels; the base having upwardly turned side edges forming outer upwardly projecting side walls and including locating means integrally joined with the top and forming fixed inner upwardly projecting side walls of the base, the inner and outer upwardly projecting side walls defining upwardly opening, horizontal channels extending along the sides of the base, and the base further integrally including upwardly projecting front and back wall means for blocking opposing ends of the channels; the sides having inwardly turned bottom and top edges sized and shaped to engage in the horizontal channels of the top and the base as a close location fit, such that when the cabinet is assembled the sides are supported on the base and located against horizontal movement in any direction by the inner and outer side walls and front and back wall means of the base and of the top and such that the top is supported directly on the sides to form a continuous closed outer top surface of the cabinet.

2. A cabinet according to claim 1 in which each of the sides has a front edge bent through at least two substantially right angle bends to define a vertical channel, and including a frame member having legs adapted to be located in respective ones of the vertical channels and a bridging member connecting the tops of the legs and adapted to form a top front frame member of the cabinet.

3. A cabinet according to claim 2 in which each vertical channel and an upper portion of each leg have dimensions in horizontal cross section such that the upper portion of each leg is a loose fit in an associated vertical channel for easy assembly but each leg has a lower portion with a horizontal cross section dimension greater than a corresponding horizontal cross section dimension of the upper portion of the leg, such that the lower portion of the leg is a close location fit in a lower portion of the associated vertical channel when the cabinet is assembled.

4. A cabinet according to claim 3 in which the lower portion of each leg extends into the associated horizontal channel in the base.

5. A cabinet according to claim 1 including a divider panel and in which the top and base are formed with further fixed locating means defining horizontal channels into which respective top and bottom edges of the divider panel can be pushed as a close location fit.

6. A cabinet according to claim 1 in which the top and base have back edges having respectively downwardly and upwardly turned lips therealong and the back has planar upper and lower edges which fit between the top and base within the lips when the cabinet is assembled.

7. A cabinet according to claim 1 in which the back has forwardly projecting side edges which locate against outside surfaces of the sides when the cabinet is assembled.

8. A cabinet according to claim 1 including wheels pre-fixed to the base on which the base may be supported.

9. A cabinet according to claim 5 in which the horizontal channels in the top have openings which are outwardly tapered to assist fitting of the top to the sides.

10. A cabinet according to claim 6 in which the back has forwardly projecting side edges which locate against outside surfaces of the sides when the cabinet is assembled.

11. A knockdown cabinet according to claim 1 assembled without the use of any separate fasteners.

12. A knockdown cabinet made from sheet material comprising a top, a base, a back and two sides, the top having downwardly turned side edges forming outer downwardly projecting walls and including locating means forming fixed inner downwardly projecting walls of the top, the inner and outer downwardly projecting walls defining downwardly opening, horizontal channels extending along the sides of the top, the base having upwardly turned side edges forming outer upwardly projecting walls and including locating means forming fixed inner upwardly projecting walls of the base, the inner and outer upwardly projecting walls defining upwardly opening, horizontal channels extending along the sides of the base, the sides having inwardly turned bottom and top edges shaped to engage in the horizontal channels of the top and the base as a close location fit, such that when the cabinet is assembled the sides are supported on the base and located against horizontal movement by the inner and outer walls of the base and the top, each of the sides having a front edge bent through at least two substantially right angle bends to define a vertical channel, and including a frame member having legs adapted to be located in respective ones of the vertical channels and a bridging member connecting the tops of the legs and adapted to form a top front frame member of the cabinet, and including hinge support members mounted on at least one of the legs and including at least one door adapted to be hung on the hinge support members to form an openable front of the cabinet.

13. A cabinet according to claim 12 in which each vertical channel and an upper portion of each leg have dimensions in horizontal cross section such that the upper portion of each leg is a loose fit in an associated vertical channel for easy assembly but each leg has a lower portion with a horizontal cross section dimension greater than a corresponding horizontal cross section dimension of the upper portion of the leg, such that the lower portion of the leg is a close location fit in a lower portion of the associated vertical channel when the cabinet is assembled.

14. A cabinet according to claim 13 in which the lower portion of each leg extends into the associated horizontal channel in the base.

15. The cabinet of claim 1 wherein the base is continuous closed for bearing all weight of all contents of the cabinet.

16. The cabinet of claim 1 wherein the front and back wall means of the top are provided by lips of the top downwardly turned along front and back edges of the top and wherein the front and back wall means of the base are provided by lips of the base upwardly turned along front and back edges of the base.

17. The cabinet of claim 1 wherein the location fit between each of the sides and the channels of the base is sufficiently close that each of the sides is pushed into a channel of the base and wherein the locational fit between each of the sides and the channels of the top is sufficiently close that the channels of the top are pushed onto each of the sides to assemble the cabinet.

18. The cabinet of claim 5 wherein the back wall means of the top is provided by a lip of the top downwardly turned along a back edge of the top, wherein the back wall means of the base is provided by a lip of the base upwardly turned along a back edge of the base, wherein the back has an upper edge received between the downwardly turned back lip of the top and an end of the further fixed locating means of the top and wherein the back further has a bottom edge received between the upwardly turned back lip of the base and an end of the further fixed locating means of the base.

19. The cabinet of claim 18 wherein the back has a pair of turned, forwardly projecting side edges locating against outer surfaces of the sides when the cabinet is assembled.

20. The cabinet of claim 5 wherein the divider panel has double return front and back lips each formed with cutouts, wherein one of the sides faces the cutouts of the divider panel and has double return front and back lips each with cutouts, and wherein the cabinet further comprises a pair of sheet metal shelf supports means for receiving and supporting another element thereon within the cabinet, each shelf support means having a pair of tabs located in the cutouts of the divider and the one side.

* * * * *